US005369827A

United States Patent [19]

Parke et al.

[11] Patent Number: 5,369,827

[45] Date of Patent: Dec. 6, 1994

[54] MEDICAL STIRRUPS

[75] Inventors: Torsten H. Parke, Dallas, Tex.; Michael R. Delaney, Springfield, Mo.; Robert Pickens, Dallas, Tex.

[73] Assignee: Mend Technologies, Inc., Dallas, Tex.

[21] Appl. No.: 484,219

[22] Filed: Feb. 21, 1990

[51] Int. Cl.[5] ..... A61H 1/00; A61G 13/00

[52] U.S. Cl. ..... 5/649; 5/651; 5/650

[58] Field of Search ..... 5/624, 648, 649, 650, 5/651

[56] References Cited

U.S. PATENT DOCUMENTS

| | | | |
|---|---|---|---|
| 542,390 | 7/1895 | Linn | 5/624 |
| 2,204,266 | 6/1940 | Wilcox | 5/624 |
| 2,257,491 | 9/1941 | Armstrong | 5/624 |
| 2,306,031 | 12/1942 | Anderson et al. | 5/624 |
| 2,391,717 | 12/1945 | Lawrence | 5/624 |
| 2,470,026 | 5/1949 | Freund | 5/624 |
| 3,944,205 | 3/1976 | Mueller | 5/649 |
| 3,982,742 | 9/1976 | Ford | 5/649 |
| 4,407,277 | 10/1983 | Ellison | 5/648 |
| 4,426,071 | 1/1984 | Klevstad | 5/624 |
| 4,428,571 | 1/1984 | Sugarman | 5/648 |
| 4,443,005 | 4/1984 | Sugarman et al. | 5/648 |
| 4,545,573 | 10/1985 | Murphy | 5/624 |
| 4,913,413 | 4/1990 | Raab | 5/624 |
| 4,940,218 | 7/1990 | Akcelrod | 5/624 X |

*Primary Examiner*—Michael Milano

[57] ABSTRACT

A medical stirrup supporting and positioning apparatus which provides three dimensional adjustment. The stirrup features a single locking member which simultaneously locks the stirrup into two of three non parallel planes. It also includes a free-floating boot which together with the locking device allows the stirrup to be locked in a horizontal plane and also locked in the adduction or abduction position, but the boot is still free to tilt forward and backwards between safety stop positions.

10 Claims, 4 Drawing Sheets

MEDICAL STIRRUPS

BACKGROUND OF THE INVENTION

This invention relates to medical accessories and more particularly to accessories that are adapted for positioning a patient for examination or surgery. A variety of medical positioning devices have heretofore been known illustrative of which are those generally employed for positioning a patient's lower extremities in a condition favorable for examination or surgery by medical personnel. Generally, these have taken the form of stirrups or the like into which a patient's feet are positioned and supported adjacent to an associated examination or surgical table or the like while the patient is in a reclining position. Some of these devices have employed a plurality of positioning controls and locking devices so as to provide three dimensional positioning and support which hold their legs firmly in place.

While the foregoing mechanisms have proven to be satisfactory, the necessity for the aforementioned plurality of adjusting and locking controls has added to the time and difficulty with which optimum positioning could be made. Moreover, these devices if secured improperly, can result in injury to the patient. Also, some of the devices of the prior art have been complex to manufacture and required features that added substantially to costs. Thus, there has continued to be a need for adjustable medical stirrup that is safer, relatively simple, low in cost, and easy to manufacture.

OBJECTS AND FEATURES

Accordingly, it is one general object of the invention to improve medical stirrups.

It is still another object of the invention to render such stirrups more easily adjustable and to reduce the number of controls required to effect adjustment and to have those controls so as to not compromise the safety of the patient.

It is yet another object of the invention to simplify medical stirrup adjusting members and to reduce costs and complexity of manufacture.

Accordingly, in accordance with one feature of the invention, there is provided an elongated generally extendable device having at one end a stirrup member adapted for support and at the other end a mating member adapted for supporting engagement with an operating table or the like, whereby the apparatus is maintained in place by the force of gravity and is readily removable by mere vertical pressure, thereby facilitating the attachment of the device to the operating table or other support.

In accordance with another feature of the invention, there is supplied a simple slide groove and slide member along the aforementioned extension, thereby facilitating adjustment to compensate for differences in the length of patients' limbs.

In accordance with yet another feature of the invention, at the stirrup end of the assembly, there is provided a simple mechanism which permits multi-dimensional orientation of the stirrup and is locked in a desired configuration by a single locking mechanism member, thereby contributing substantially to the simplicity of use of the equipment.

In accordance with still another feature of the invention, the device employs safety stops to prevent over adduction or abduction of the patient's legs.

In accordance with yet another feature of the invention, the device employs such a locking device as to lock the horizontal rotation and the degree of adductive and abductive angle without locking the forward or backward tilt of the stirrup boot, thus improving the safe usage of the device.

In accordance with yet another feature of the invention, through the employment of the aforementioned single locking mechanism, and the attendant simplification, the equipment is reduced in cost and complexity of manufacture.

These and other objects and features of the invention will be apparent from the following description by way of a preferred embodiment, with reference to the drawing.

THE DRAWING

DETAILED DESCRIPTION OF THE INVENTION

Figure 1:
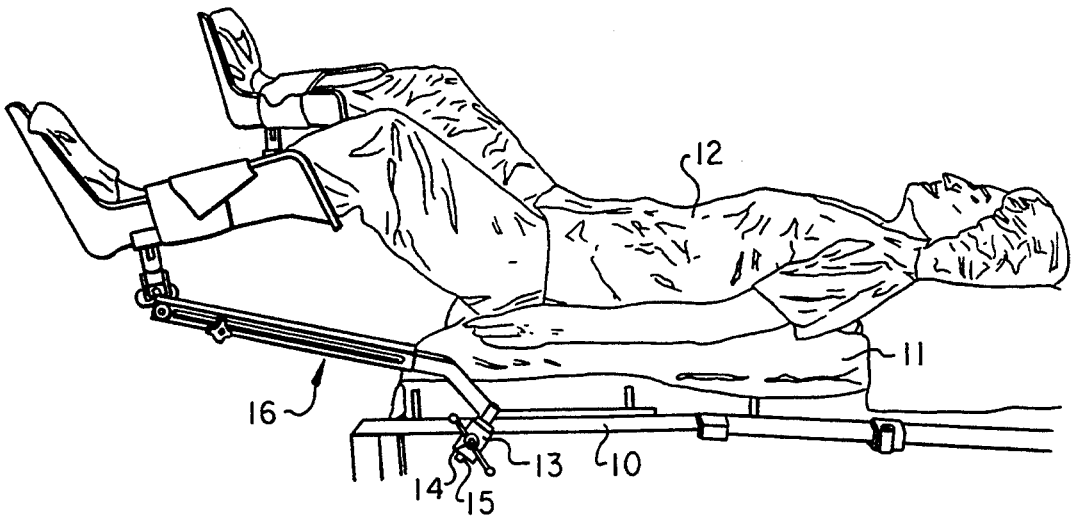
FIG. 1 is a view illustrating typical use of equipment embodying the principles of the invention.

FIG. 1 depicts a typical use of medical stirrups embodying the principles of the present invention. A typical operating or examining table 10 is shown in part and is fitted with conventional pad 11 for supporting patient 12. Connected to table 10 is adapter 13 which is fitted with tightening member 14. Adapter 13 includes a cylindrical orifice therethrough (not shown) adapted for mated fitting with projection 15 (FIG. 2) of stirrup assembly 16. Thus, stirrup assembly 16 is made easily removable from the examining table so that it can be readily transported from one point of use to another and/or stored when not in service.

As will be observed from further reference to FIG. 1, the stirrups are utilized to provide support and positioning for a patient's lower extremities on undergoing various types of medical examination or surgery. Thus, the stirrups not only provide for the separation of the patient's lower extremities so as to enhance visual access and surgical to lower body portions, but preferably further include the capability of orthogonal adjustment so as to provide optimum adjustability.

Figure 2:
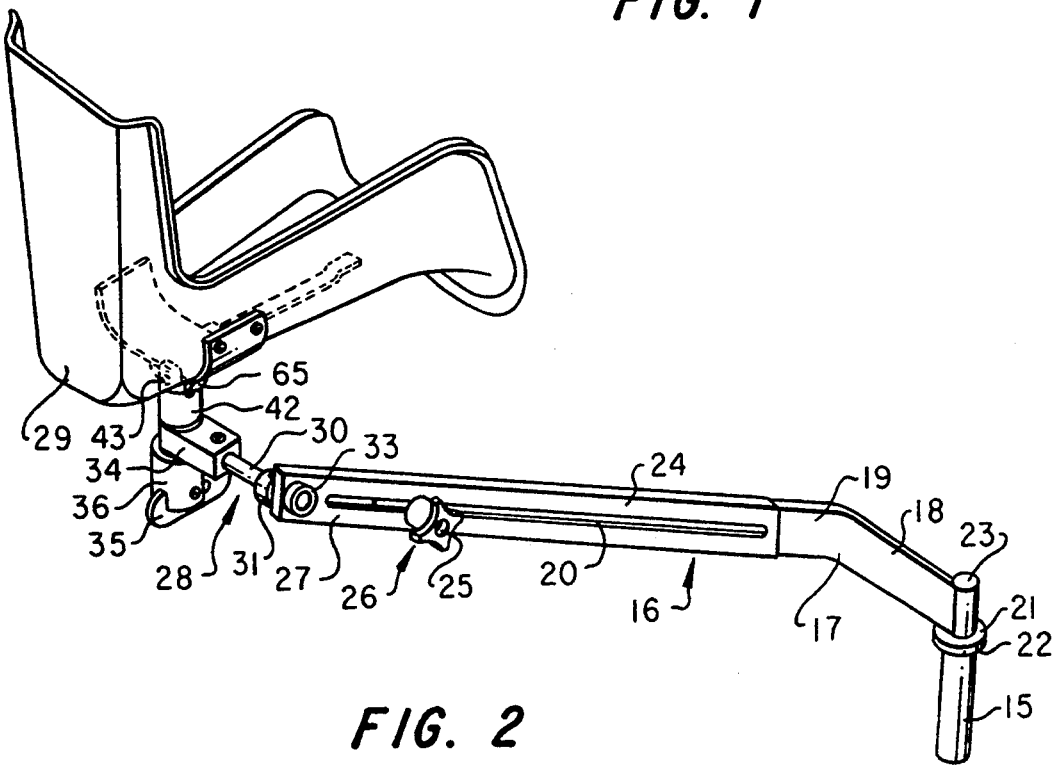
FIG. 2 is a perspective view depicting the assembled apparatus.

FIG. 2 illustrates one of the customary pair of stirrup assemblies 16. It will be understood that the remaining stirrup assembly is a mirror image of that depicted in FIG. 2 and as is illustrated in FIG. 1.

Now examining FIG. 2 in greater detail, it will be observed that it depicts an assembled apparatus in accordance with the invention. The assembly, generally identified at 16 includes at one end thereof a cylindrically shaped projection 15 preferably integrally formed with extending arm 17. As will be observed, extending arm 17 comprises two principal portions, 18, and 19.

Positioned upwardly on cylindrically shaped projection 15 is an optional collar member 21, the exterior surface 22 of which may be knurled so as to facilitate gripping. The interior surface of optional collar member 21 is sized so as to fit snugly around projection 15 and may be fastened thereto by any conventional means such a recessed set screw.

Portion 18 of extending arm 17 is seen to project somewhat upwardly so that the remaining portion 19 of extending arm 17 is at a higher level than the top 23 of projection 15. Although such upward direction is deemed preferable, it should be noted by one skilled in the art that it is not essential to the effective utilization of the principles of the invention.

Portion 19 of extending arm 17 is seen to extend essentially horizontally for some distance, the length of which is not critical to the invention. The length of such extension will vary, depending upon the location on the examining or surgical table to which the cylindrically shaped extension 15 is attached, the expected position of the patient to be examined, and the range of sizes of patients for which the equipment is adapted. Thus, in the case of an examining facility for examining infants, the length of extension 19 may be substantially less than in equipment adapted for examination of fully grown adults. In any event, however, the length of portion 19 of extending arm 17 is sized to provide the desired range of adjustability for the length of the limbs of the examinees.

As will be observed from further reference to FIG. 2, portion 19 of extending arm 17 provides a sliding sleeve arrangement in which the exterior sleeve 24 is adapted for slideable mating with the exterior surface of portion 19 of extending arm 17, thus permitting a smooth slideable engagement therebetween. Slot 20 is seen to traverse the major portion of the length of exterior sleeve 24, thus permitting a wide latitude of extension or retraction thereof.

Projecting outwardly from portion 19 of extending arm 17, is a threaded stud 25 on which there is mounted in a conventional manner, a locking knob 26 which, when tightened, provides a frictional locking of exterior sleeve 24 so as to hold it in the desired position.

Figure 3:
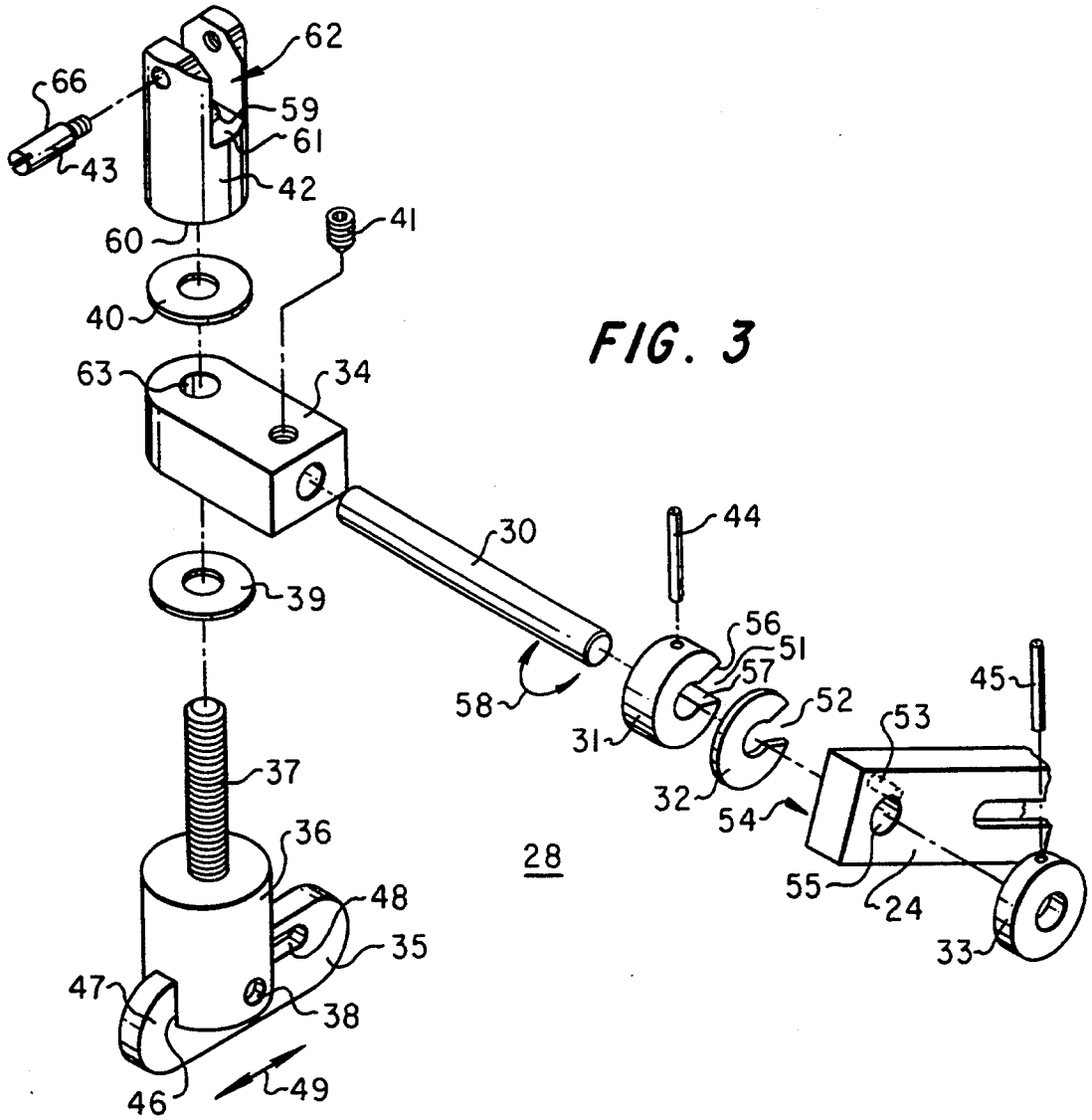
FIG. 3 is an exploded view illustrating details of the orientation and locking mechanism.

Near the outward end 27 of exterior sleeve 24 there is seen support and adjustment assembly 28 which supports and connects stirrup 29 to extending arm 17. Details of this support and adjustment assembly 28 are depicted in FIG. 3 and include arm 30, inner collar 31, washer 32, outer collar 33, connecting block 34, operating key 35, cylindrical connecting member 36, threaded projecting stud 37, holding pin 38, lower washer 39, upper washer 40, retaining set screw 41, upper connecting block 42 and swivel pin 43. Also included are conventional retaining pins 44 and 45 which are employed to affix inner collar 31 and outer collar 33 respectively to arm 30.

Cylindrical connecting member 36 is seen to include a slot 46 extending therethrough and into which there is fitted the upper portion 47 of operating key 35. Operating key 35 is further seen to include an elongated slot 48 through which holding pin 38 extends so as to retain operating key 35 in assembly with cylindrical connecting member 36. However, slot 48 is dimensioned so as to permit operating key 35 to move freely in the directions shown by arrows 49.

Collar 31 and its associated washer 32 are both seen to be segmented by corresponding slots 51 and 52, thus providing an opening into which projecting pin 53 extends essentially at right angles to the planar inner surface 54 of exterior sleeve 24, thus permitting limited angular rotation of arm 30 and corresponding angular movement of stirrup 29 when it is attached to connecting block 42, thus improving safety when utilized with a patient in situ.

As will be observed to one skilled in the art, in order to permit the limited angular rotation described in the immediately preceding paragraph, it is necessary that aperture 55 be slightly larger in diameter than the diameter of arm 30 so as to provide a snug but movable fit. Accordingly, as arm 30 is rotated, it will reach a limit at which projecting pin 53 engages either surface 56 or 57 of inner collar 31. This will be seen in greater detail in FIG. 7 and as illustrated in FIG. 3 by circular arrow 58.

Upper connecting block 42 is seen to include a threaded aperture 59 extending axially therethrough from its lower extremity 60 to the lower surface 61 of slot 62. Thus, when assembly 28 is fully assembled, projecting stud 37 extends upwardly through unthreaded loosely fitting aperture 63 and thence into mating threads 64 (FIGS. 4 and 5) within threaded aperture 59 of upper connecting block 42.

Figure 4:
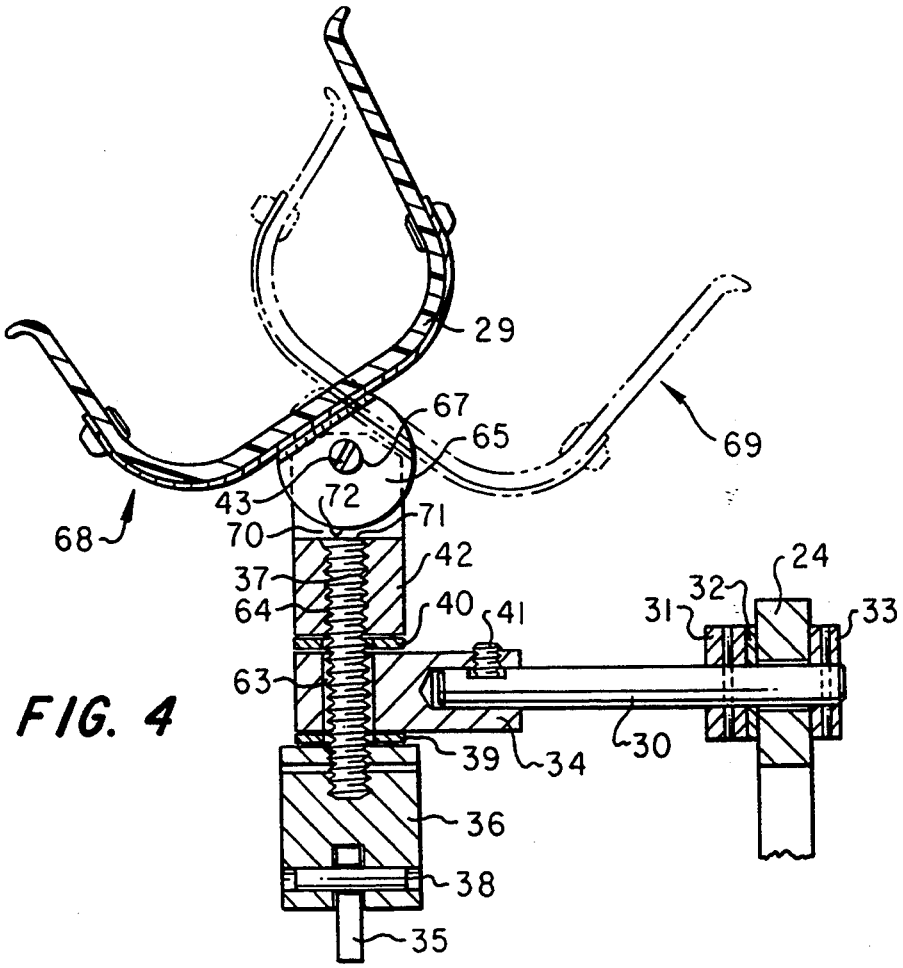
FIG. 4 is a partly sectioned view illustrating the span of heeling provided for the stirrup.
Figure 5:
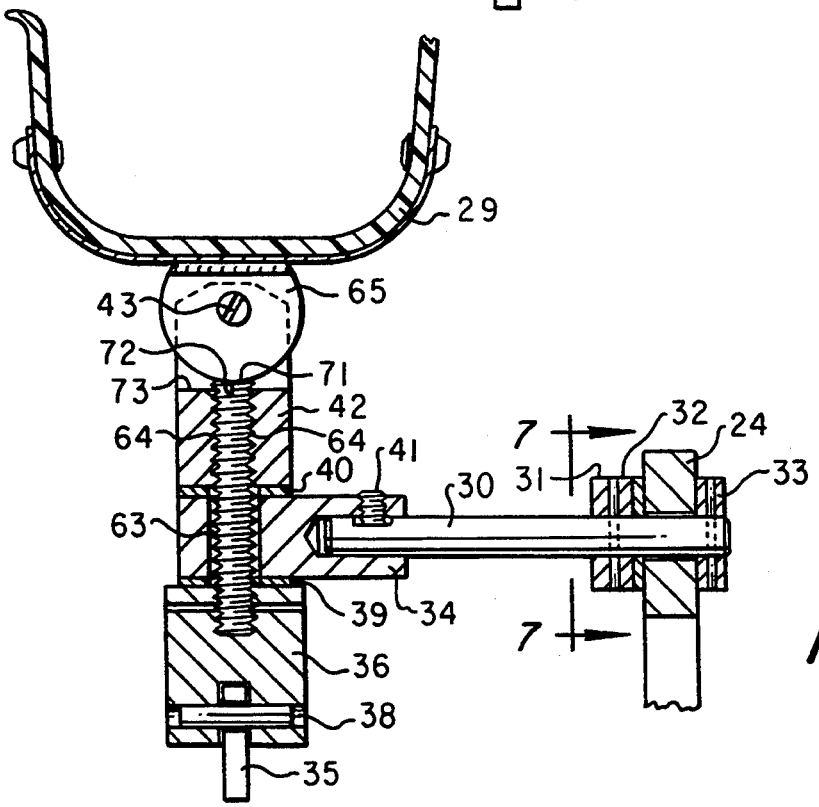
FIG. 5 is a view similar to that of FIG. 4 but with the stirrup in a horizontal position.

FIGS. 4 and 5 illustrate the assembly of the support and adjustment assembly 28 with the stirrup 29. There, it will be seen that fitted within slot 62 (FIG. 3) and retained in place by swivel pin 43 is mating partially circular connector 65. As will be observed from inspection of FIGS. 4 and 5, sufficient clearance exists between the exterior surface 66 (FIG. 3) of swivel pin 43 and the inner mating cylindrical surface of aperture 67 of connector 65 (FIGS. 4 and 5) so as to permit free partial angular rotation of stirrup 29 thereabout as shown by positions 68 and 69 of stirrup 29.

To permit the aforementioned limited angular positioning of stirrup 29 and between positions 68 and 69, threaded stud 37 is shown in its lower or recessed position according to which clearance 70 exists between the upper end 71 of threaded projecting stud 37 and the adjacent lower surface 72 of connector 65. When it is desired to lock stirrup 29 into a fixed relationship with respect to connecting block 34, threaded projecting stud 37 is rotated by turning cylindrical connecting member 36 by means of operating key 35 until the upper end 71 of threaded stud 37 projects above lower surface 61 of slot 62 in upper connecting block 42 as shown in FIG. 3 until upper surface 71 firmly engages lower adjacent surface 72 of connector 65 thus preventing angular movement of stirrup 29 about swivel pin 43; at the same time, locking connecting block 42 to connecting block 34 by frictional engagement through washers 39 and 40. Thus, the rotation of cylindrical connecting member 36 and the corresponding rotation of threaded projecting stud 37 serves to perform two locking functions: the locking of stirrup 29 to prevent rotational movement about the axis of swivel pin 43 and concurrently locking it through upper connecting block 42 and washers 39/40 to prevent rotational movement about the axis of threaded projecting stud 37.

As mentioned above, the provision of slots 51 and 52 in collar 31 and adjacent washer 32 operate in cooperative relationship with projecting stop pin 53 to permit a limited angular rotation of arm 30. This is better shown in FIG. 6 which is a side view of the stirrup as shown in solid lines at one limit of such movement and in phantom lines at the other extreme.

Figure 6:
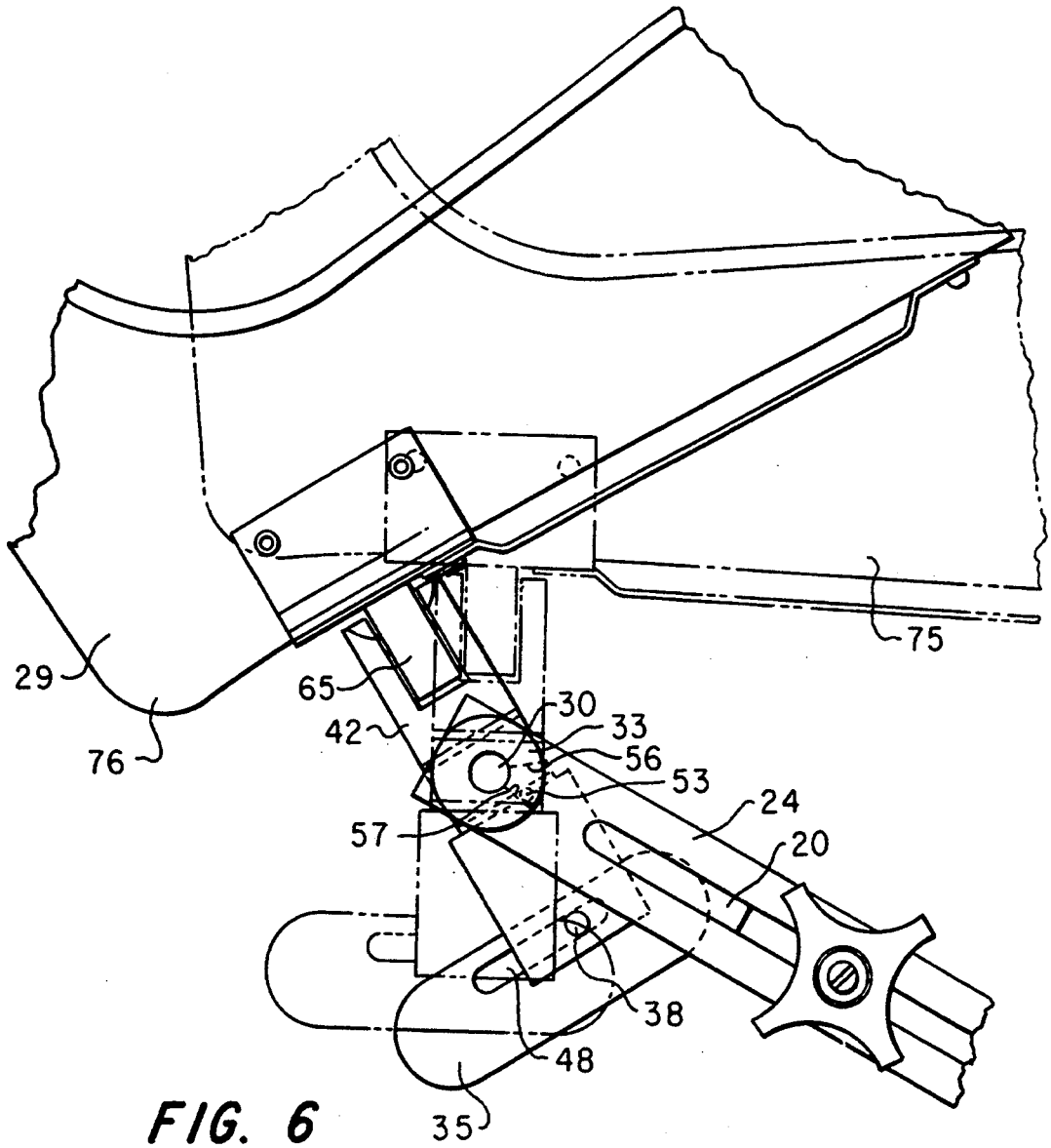
FIG. 6 is a detailed view illustrating the swiveling feature of the stirrup in a vertical plane.

FIG. 6 illustrates the movement of the stirrup 29 between the angular limits established by the aforementioned safety slots 51 and 52 in collar 31 and 32 respectively. As mentioned above, arm 30 is limited in its angular rotation between the limits imposed by the width of the slots 51 and 52. At one extreme, the stirrup 29 is shown in its essentially horizontal position 75 and at the other limit it is shown in position 76. It should, of course, be understood that greater or lesser latitude of angular rotation could be readily provided by increasing or reducing the width of safety slots 51 and 52.

Figure 7:
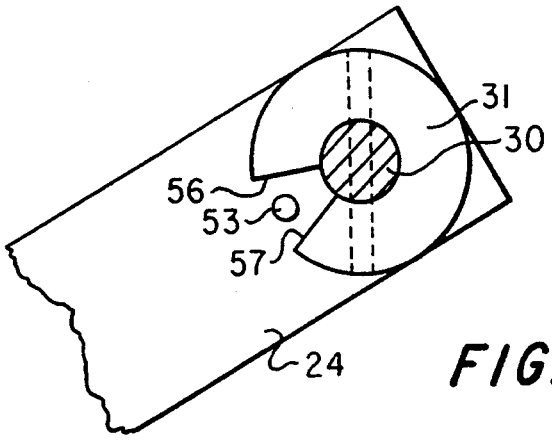
FIG. 7 is a detail view along the section lines 7—7 of FIG. 5.

Now turning to FIG. 7, the details of the aforementioned slotted configuration are shown in greater detail. Since this has been described with respect to FIG. 3, reference is made to that descriptive passage for an understanding of its operation.

It will now be evident that there has been described herein improved medical stirrups having substantially improved features. Although the inventive concepts hereof have been illustrated by way of a preferred embodiment, it will be evident to those skilled in the art that other adaptations and modifications may be employed without departing from the spirit and scope of the invention. Thus, for example, the feature of complete rotation of the stirrup around one axis could be modified to limit such rotation between predetermined safety stops.

The terms and expressions used herein have been employed as terms of description and not of limitation; and thus there is no intent in the use thereof of excluding any and all equivalents but on the contrary it is intended to include all adaptations and modifications that may be employed without departing from the spirit and scope of the invention as defined in the claims.

What is claimed is:

1. Improved medical stirrup apparatus comprising:

(a) an elongated support having two principal ends;

(b) supporting means positioned at one of said two principal ends of said elongated support for supporting said elongated support;

(c) a stirrup;

(d) adjustment means affixed to the other of said two principal ends for adjustably connecting said stirrup to said elongated support, said adjustment means including:

(i) positioning means for adjustably positioning said stirrup about three non-parallel axes;

(ii) free-floating movement means for permitting said stirrup to rotate through a predetermined arc of less than 180 degrees about one of said three non-parallel axes; and (iii) a single locking means for locking said stirrup about the other two of said three non-parallel axes while permitting said free-floating movement.

2. An improved medical stirrup apparatus according to claim 1 in which said three non-parallel axes are orthogonal.

3. An improved medical stirrup apparatus according to claim 2 further including rotation means for providing complete rotational adjustment around at least one of said non-parallel axes.

4. An improved medical stirrup apparatus according to claim 1 wherein said predetermined arc is less than 90 degrees and wherein said stirrup is permitted to rotate only about said one of said three non-parallel axes when said single locking means is locked.

5. An improved medical stirrup apparatus according to claim 3 wherein said predetermined arc is less than 90 degrees and wherein said stirrup is permitted to rotate only about said one of said three non-parallel axes when said single locking means is locked.

6. An improved medical stirring apparatus according to claim 2 further including rotation means for providing complete rotational adjustment around one of said other two non-parallel axes when said single locking means is unlocked, wherein said predetermined arc is less than 90 degrees, and wherein said stirrup is permitted to rotate only about said one of said three non-parallel axes when said single locking means is locked.

7. An improved medical stirrup apparatus according to claim 1 wherein said elongated support includes adjusting means for extending and retracting the effective length thereof.

8. An improved medical stirrup apparatus according to claim 1 wherein said supporting means includes means for disconnecting said supporting means.

9. An improved medical stirrup apparatus according to claim 1 wherein said elongated support includes adjusting means for extending and retracting the effective length thereof and wherein said supporting means includes means for disconnecting said supporting means.

10. An improved medical stirrup apparatus according to claim 1 wherein said single locking means includes a connecting member, a partially rotatable axially elongated member having two ends and being affixed at one of said ends to said elongated support and at the other of said ends to said connecting member, and an upper connecting block adjacent said connecting member and being fully 360° rotatable about an axis disposed at right angle with respect to the axis of said partially rotatable axially elongated member.

* * * * *